United States Patent [19]

Mahieu

[11] Patent Number: 5,074,126

[45] Date of Patent: Dec. 24, 1991

[54] MOBILE REFRIGERATED CHAMBER FOR FOOD PRODUCTS

[75] Inventor: Bernard Mahieu, Paris, France

[73] Assignee: Societe Conseil Investissements Management Pour l'Entreprise C.I.M.E. Sarl, Paris, France

[21] Appl. No.: 490,614

[22] PCT Filed: Sep. 30, 1988

[86] PCT No.: PCT/FR88/00484

§ 371 Date: Mar. 26, 1990

§ 102(e) Date: Mar. 26, 1990

[87] PCT Pub. No.: WO89/03008

PCT Pub. Date: Apr. 6, 1989

[30] Foreign Application Priority Data

Oct. 2, 1987 [FR] France ..... 87 13668

[51] Int. Cl.[5] ..... F25D 3/12

[52] U.S. Cl. ..... 62/388; 62/542; 62/500

[58] Field of Search ..... 62/387, 388, 384, 62, 62/54.2, 500

[56] References Cited

U.S. PATENT DOCUMENTS

| | | | |
|---|---|---|---|
| 2,167,667 | 8/1939 | McMechan | 62/167 |
| 2,255,356 | 9/1941 | Harris et al. | 62/387 |
| 2,580,210 | 12/1951 | Zuckerman | 62/387 |
| 3,163,022 | 12/1964 | Hottenroth | 62/388 |
| 3,447,334 | 6/1969 | Kimball | 62/64 |
| 3,864,936 | 2/1975 | Frank et al. | 62/384 |
| 4,096,707 | 6/1978 | Taylor | 62/167 |
| 4,457,142 | 7/1984 | Bucher | 62/388 |
| 4,576,010 | 3/1986 | Windecker | 62/64 |
| 4,593,536 | 6/1986 | Fink et al. | 62/388 |

FOREIGN PATENT DOCUMENTS

| | | |
|---|---|---|
| 392882 | 2/1933 | Belgium . |
| 0175044 | 3/1986 | European Pat. Off. . |
| 3008355 | 9/1981 | Fed. Rep. of Germany . |
| 756085 | 12/1933 | France . |

*Primary Examiner*—Ronald C. Capossela
*Attorney, Agent, or Firm*—Young & Thompson

[57] ABSTRACT

An installation for generation of a refrigerated gas flow from a mass of refrigerating material in solid or liquid state, includes a closed vaporization chamber (4) containing a charge (7) of refrigerating material in liquid or solid state and capable of resisting pressure. An ejector (9) of the Venturi type ensures the drive of a much greater gaseous flow rate by a drive stream of gas under pressure. A conduit (12) connecting the closed vaporization chamber (4) to the ejector (9) to feed to this latter the gas from the chamber by vaporization or sublimation of the refrigerating material as a drive flow of gas under pressure. The outlet of the ejector (9) is connected to a sleeve (10) whose length extends through a refrigerating chamber. This sleeve has along its length outlet nozzles (11) to distribute the refrigerated gas flow throughout the volume of the refrigerated chamber and to ensure the agitation of the air in this latter by jets of gas from the nozzles. The closed vaporization chamber (4) encloses a conduit (6) in heat exchange contact with the mass (7) of refrigerating material. This conduit is connected between the atmosphere of the refrigerated chamber and the intake of the drive ejector (9).

3 Claims, 2 Drawing Sheets

MOBILE REFRIGERATED CHAMBER FOR FOOD PRODUCTS

Figure 1:
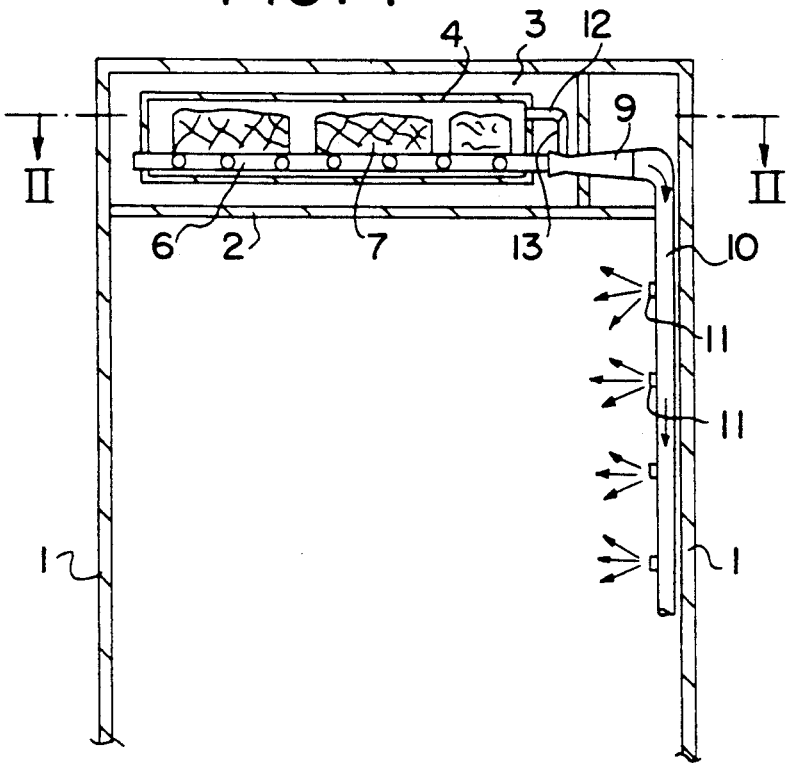

The present invention relates to the generation of a flow of refrigerated gas, and particularly cold air, from a mass of a refrigerating substance in sublimable solid condition or vaporizable liquid condition at a temperature lower than the desired temperature for the refrigerated gas. It relates more particularly to the use of the process for maintaining and rendering uniform the temperatures in the mobile refrigerated chamber containing food substances or the like from a solid mass of carbon dioxide, called carbon dioxide snow, and particularly the refrigeration of carts carried aboard aircraft, trains or the like or containers of the same type adapted to enclose food products, and particularly prepared dishes adapted to be served in the course of a trip or after a certain period of preservation.

At present, either the carts are maintained in climatized storage and individually connected to a refrigerating installation from which they must be disconnected for distribution, or they have a compartment adapted to receive a charge of refrigerant material, cakes of ice or solid carbon dioxide, with which compartment the air of the refrigerated chamber circulates in heat exchange by natural convection.

The first solution has the drawback of requiring a refrigerating and climatizating installation and of comprising numerous conduits which must be disconnected before the carts can be moved. The second solution does not have these drawbacks but the distribution of the refrigeration solely by natural convection which gives rise to descending gas currents of low velocity, results in very great inequalities of temperature prevailing in the different parts of the refrigerated chamber with lower temperatures adjacent the compartment of refrigerating substance, particularly when this latter is solid carbon dioxide which, at atmospheric pressure, vaporizes by sublimation at a temperature of about −79° C. Forced circulation by a fan would require an electrical connection of the cart or container with the drawbacks indicated above.

There has also been proposed (U.S. Pat. No. 3,163,022) the use of vaporization or sublimation of a body, for example of "Dry Ice", to create a gaseous flow driving the atmosphere of a chamber to be refrigerated, with acceleration through a Venturi. Such a device (German patent No. 3,008,355) has been proposed for a cart carried on aircraft but has not been put into use because of the lack of uniformity of the temperatures obtained. The same is true of other known devices (U.S. Pat. No. 3,447,334, U.S. Pat. No. 4,576,010).

The present invention has for its object to overcome these drawbacks by providing in the refrigerated chamber, from a supply of refrigerating material which vaporizes to release in said chamber the refrigeration of the change of state, a forced flow of refrigerated air which can be directed so as to be uniformly distributed in the various portions of the refrigerated chamber without recourse to a power source external to the refrigerated chamber to ensure this forced circulation. It also has the object of ensuring autoregulation of the flow and of the temperature of the refrigerated air as a function of the ambient temperature of the refrigerated chamber.

This object is achieved, according to the invention, thanks to a process for generation of a flow of refrigerated gas from a mass of refrigerating material in solid or liquid state, in which there is sublimed or vaporized in a sealed vaporization chamber said refrigerating material and there is utilized the gaseous flow under pressure thus produced as the entrainment stream for a flow of gas to be refrigerated through a gas ejector of the Venturi type, characterized in that the mixture of gas to be refrigerated and of drive gas leaving the gas ejector is sent to the chamber to be refrigerated by a plurality of vaporization nozzles distributed throughout said chamber to be refrigerated.

The refrigerating substance used in the process can be any substance in solid or liquid state which sublimes or vaporizes at a low temperature with a high refrigerating capacity. In practice is is preferable to utilize the carbon dioxide already used in such installations and which is for this reason commercially available and conventionally usable. Carbon dioxide or carbon dioxide snow vaporizes by sublimation at −79° C. at atmospheric pressure with release of refrigeration of 177 Wh/kg (153 kcal/kg). However there could also be used within the scope of the invention a liquefied gas such as liquid nitrogen or liquid air.

According to another characteristic of the invention, the sublimation or vaporization of the refrigerant material is ensured by circulation in heat exchange contact with the mass of this material of the air of the chamber to be refrigerated. This circulation is preferably of the forced type in a serpentine conduit in contact with the mass of the refrigerant material, the forced circulation being ensured by the aspiration of the gas ejector. In this way, there is obtained an autoregulation due to the mass of refrigerant material vaporized per time period dependent both on the temperature of the air of the refrigerated chamber and on its flow rate aspirated by the ejector, this flow rate being itself the higher, the higher is the temperature in the refrigerated chamber. It is moreover possible to control the temperature of the exiting gas flow by reducing, to a portion of the flow rate of the air aspirated by the ejector, the flow rate of the ambient air circulating in heat exchange contact with the mass of refrigerant material or by limiting the flow rate of the driving gas to a fraction of the volume of the gas vaporized from the refrigerating substance.

According to another characteristic, and to increase the volumetric flow of the flow motor, therefore of the flow entrained, the vaporized volume is subjected to reheating by heat exchange contact with the air of the refrigerated chamber before its entry into the driving ejector.

According to another characteristic, and to augment the flowing mass of air aspirated entrained by the ejector, there is caused in a first stage this air to circulate in heat exchange contact with the wall of the vaporization chamber. With this feature, the air of the vaporization chamber is cryogenically dried before its passage into the serpentine vaporization tube of the refrigerant material wherein the remaining humidity may be deposited and a completely dry gas is admitted to the entrainment ejector, which avoids the risk of clogging of this member by ice deposits. Preferably, the flow rate of air aspirated by the ejector and preliminarily placed into heat exchange contact with the wall of the vaporization chamber is adjustable and may be short-circuited so as to be brought directly to the inlet of the gas ejector.

The refrigeration installation for practicing the process according to the invention consists essentially in a closed vaporization chamber adapted to receive a charge of refrigerant material in liquid or solid state and to withstand pressure, an ejector of the Venturi type ensuring driving of a much greater flow rate of gas from a gas flow motor under pressure and conduits connecting said closed vaporization chamber to said ejector to feed to the latter the gas from the chamber for the vaporization or sublimation of the refrigerating material as a gaseous flow motor under pressure and is characterized in that the outlet of the ejector is connected to a sleeve whose length extends into the refrigerated chamber, this sleeve comprising along its length outlet orifices constituted by nozzles to distribute the refrigerated gas flow within the volume of said refrigerated chamber and to ensure the agitation of the air of this latter by gas jets leaving said nozzles.

According to another characteristic, the closed vaporization chamber encloses conduitry in heat exchange conduit with the mass of refrigerating material, this conduitry being connected between the atmosphere of the refrigerated chamber and the intake of the entrainment ejector.

According to another characteristic the conduitry connecting the closed vaporization chamber to the ejector comprises a portion forming a heat exchanger between the gas which circulates in it and the atmosphere of the refrigerated chamber.

According to another characteristic, the air of the refrigerated chamber is conducted between said chamber and the intake of the ejector so as to be in heat exchange contact with the wall of the vaporization chamber.

Preferably, in this case, the flow of the air of the refrigerated chamber in heat exchange contact is ensured by means of a thermostatic device such as a thermostatic check valve sensitive to the temperature of the refrigerated chamber, opening when the minimum temperature is achieved in this chamber, this thermostatic device being provided in the conduitry bringing the air of the chamber into heat exchange with the wall of the closed vaporization chamber. Preferably, the installation then comprises a second thermostatic device short-circuiting the air from the refrigerated chamber to convey it directly to the intake of the gas ejector.

According to another characteristic, a calibrated valve is provided on the closed vaporization chamber, the calibration of the valve corresponding to the pressure limiting the drive gas flow rate to the value ensuring the refrigeration level just necessary to maintain the internal temperature of the refrigerated chamber at a predetermined minimum. This calibrated valve also ensures safety against accidental overpressure in the vaporization chamber which is the only pressurized portion of the installation. Adjustment of the drive gas flow rate could also be effected by a thermostatic valve sensitive to the internal temperature of the refrigerated chamber which provides an outlet from the closed vaporization chamber when the minimum temperature of the refrigerated chamber is achieved.

Figure 2:
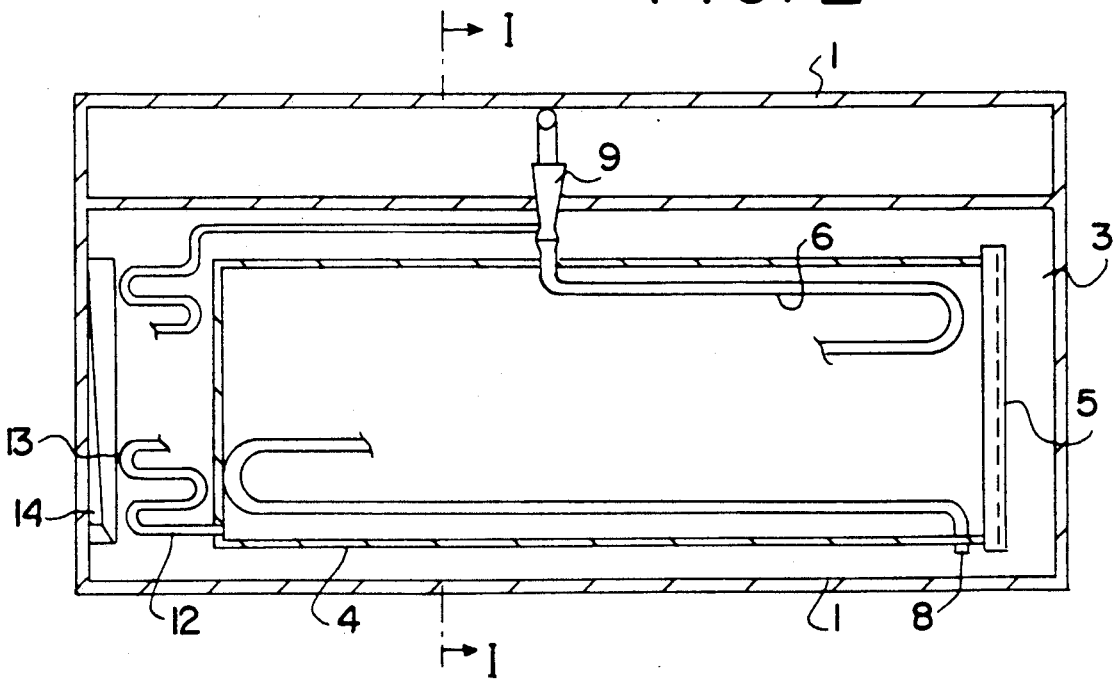
Figure 3:
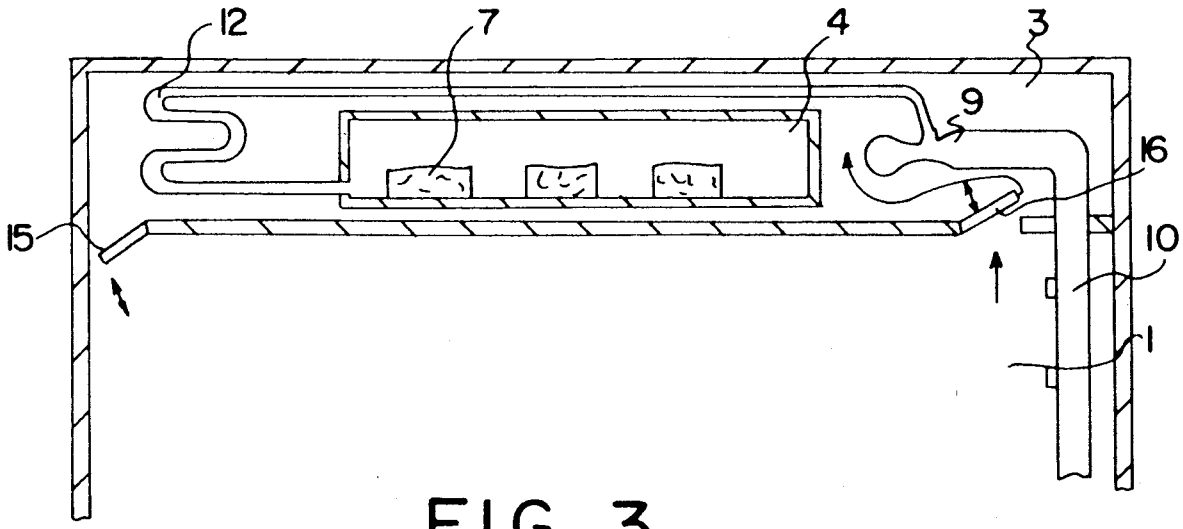

The invention will be described in greater detail hereafter as to an illustrative embodiment with reference to the accompanying drawings in which:

FIG. 1 is a schematic cross sectional view on the line I—I of FIG. 2 of a refrigerated cart comprising an installation according to the invention, FIG. 2 is a horizontal cross sectional view of it through II—II of FIG. 1 .and FIG. 3 is a simplified schematic view in longitudinal cross section of a modification of the cart of FIGS. 1 and 2.

In the drawings, reference numeral 1 designates generally the insulating walls of the container of the cart in which are disposed in a vertical stack the food platters. Within the volume of this container and at its upper portion is provided, by a separating wall 2, a separate compartment 3 in which is disposed the closed vaporization chamber or tank 4 constituted by a housing with a sealed closure cover 5.

In the closed vaporization chamber 4 and above its bottom is disposed a serpentine tube 6 the lengths of whose tube form a grill on which are placed pieces of solid carbon dioxide 7. The serpentine tube is connected between an opening 8 into the compartment 3 and the inlet of a ventilating ejector 9 of the Venturi type operating by the Coanda effect, which pumps the air, drawn through the serpentine tube 6 from the compartment 3, into a sleeve 10 terminating in nozzles 11 spaced apart within the whole of the container.

A conduit 12 leaves the closed vaporization chamber 4, and, passing through a serpentine tube 13 disposed in the compartment 3, feeds the ventilating ejector 9 with a driving gas under pressure.

Reference numeral 14 shows an inlet through which the atmosphere of the container is admitted to the compartment 3.

The heat exchanges taking place in the refrigerated chamber described by way of illustrative example of the invention and the operation of the latter, will be described hereafter.

The food platters or other products to be refrigerated are placed in the cart and blocks of solid carbon dioxide 7 are disposed in the vaporization chamber 4 whose cover 5 is closed in a sealed manner. The blocks 7 sublime with the removal of heat from the atmosphere of the chamber 4 while producing carbon dioxide gas at a temperature of −79° C. The pressure in the vaporization chamber 4 reaches a value of about 1.5 to 2 bars (150 to 200 k Pa) during operation. The gaseous $CO_2$ produced in the chamber 4 escapes through the conduit 12 and is reheated in the serpentine tube 3 by withdrawing calories from the air of the container admitted by the inlet 14 into the compartment 3. This increases the volumetric flow rate of the gas sublimed under pressure, which gas is used as driving gas in the ventilating ejector 9, at the same time that the air of the compartment 3 is subjected to a first cooling. The ventilating ejector 9 being thus fed, it draws through the serpentine tube 6 the air of the compartment 3 so as to introduce it into the sleeve 10 which distributes it throughout the container by the nozzles 11. While circulating through the serpentine tube 6, the air drawn into the compartment 3 supplies calories to the blocks of solid carbon dioxide 7 whose speed of sublimation, and hence provision of refrigerating capacity, is accordingly a function of the temperature of the air drawn into the compartment 3 and of the flow rate ensured by the ventilating ejector 9, a flow rate which is also a function of the speed of sublimation of the carbon dioxide.

The air from the exterior of the container drawn in through the inlet 14 is cooled by heat exchange with the serpentine tube 13 and then by heat exchange with the chamber 4 while circulating in the compartment 3 in contact with the walls of the latter. It loses, as a result of these two heat exchanges, the principal portion of its humidity in the form of condensation which becomes frost. The air becomes further cooled by circulating in the serpentine 6 and then mixes with the sublimed and reheated carbon dioxide gas in the serpentine tube 13 to provide a mixture whose volume is six to 12 times the volume of gas resulting from the sublimation of the blocks 7, under a pressure of 200 Pa and at a temperature of only several degrees below zero. This gaseous volume projected by the nozzles 11 ensures an intense complementary driving of the ambient air of the container, which permits achieving in this latter a completely uniform distribution of the temperatures which vary by +1° C. from the mean temperature.

So as automatically to regulate the mean temperature, there can be provided in the chamber 4 a calibrated valve, not shown, which ensures in this chamber a constant pressure and therefore a constant flow rate of the drive flow feeding the ventilating ejector 9 and consequently of the resulting flow rate or a thermostatic valve sensitive to the temperature which permits direct escape of the gases of sublimation into the chamber of the container when the mean temperature falls below the predetermined value, which direct escapement again reduces the flow rate of the ventilating ejector 9 and hence the flow rate of air within the serpentine tube 6 and the speed of sublimation of the blocks 7.

Reference will now be had to FIG. 3.

The intake of the inlet 14 can be provided with a thermostatic check valve 15 sensitive to the temperature of the refrigerated chamber 1 so as to open when a minimum temperature is achieved in this chamber 1. Preferably, a second thermostatic check valve 16, mounted reversely of valve 15, places the tank 4 in short circuit to bring the air to be cooled directly to the intake of the gas ejector 9, so as to avoid too great a temperature drop of the blown stream which risks freezing the food products contained in the refrigerated chamber, particularly when the cart is located in an unusually cool environment. In the modification of FIG. 3, a tank 4 is provided with heat exchange fins disposed on its external surface so as to increase its useful volume.

I claim:

1. An installation for generation of a refrigerated gas flow from a mass of refrigerating material in solid or liquid state, comprising essentially a closed vaporization chamber (4) adapted to receive a charge (7) of refrigerating material in liquid or solid state and capable of resisting pressure, an ejector (9) of the Venturi type ensuring the drive of a much greater gaseous flow rate by a drive stream of gas under pressure and a conduit (12) connecting said closed vaporization chamber (4) to said ejector (9) to feed to this latter the gas from the chamber by vaporization or sublimation of the refrigerating material as a drive flow of gas under pressure, characterized in that the outlet of the ejector (9) is connected to a sleeve (10) whose length extends through a refrigerated chamber, this sleeve comprising along its length outlet orifices constituted by nozzles (11) to distribute the refrigerated gas flow throughout the volume of said refrigerated chamber and to ensure the agitation of the air in this latter by jets of gas from said nozzles, the closed vaporization chamber (4) enclosing a conduit (6) in heat exchange contact with the mass (7) of refrigerating material, this conduit being connected between the atmosphere of the refrigerated chamber and the intake of the drive ejector.

2. An installation according to claim 1, characterized in that the conduit (12) connecting the closed vaporization chamber (4) to the ejector (9) comprises a portion (13) forming a heat exchanger between the gas which circulates in it and the atmosphere of the refrigerated chamber.

3. An installation according to claim 1, characterized in that the air in the refrigerated chamber (14) is conducted between said chamber and the aspiration intake (8) of the ejector (9) so as to be in heat exchange contact with the wall of the vaporization chamber (4).

* * * * *